US008936336B2

(12) United States Patent
Yokomaku

(10) Patent No.: US 8,936,336 B2
(45) Date of Patent: Jan. 20, 2015

(54) IMAGE FORMING APPARATUS AND METHOD OF DRIVING AND CONTROLLING HEAD

(71) Applicant: Hiroomi Yokomaku, Kanagawa (JP)

(72) Inventor: Hiroomi Yokomaku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/190,039

(22) Filed: Feb. 25, 2014

(65) Prior Publication Data

US 2014/0240384 A1 Aug. 28, 2014

(30) Foreign Application Priority Data

Feb. 28, 2013 (JP) ..... 2013-038320

(51) Int. Cl.
*B41J 29/38* (2006.01)
*B41J 2/045* (2006.01)

(52) U.S. Cl.
CPC ..... *B41J 2/04588* (2013.01)
USPC ..... 347/11

(58) Field of Classification Search
CPC ..... B41J 2/04581; B41J 2/04588; B41J 2/04593; B41J 2/04596; B41J 2/04541; B41J 2/04595
USPC ..... 347/9–11, 68
See application file for complete search history.

(56) References Cited

U.S. PATENT DOCUMENTS

| | | | | |
|---|---|---|---|---|
| 7,520,579 | B2 * | 4/2009 | Yoshida | 347/10 |
| 8,303,067 | B2 | 11/2012 | Kitaoka | |
| 8,757,752 | B2 * | 6/2014 | Yokomaku | 347/11 |
| 8,777,346 | B2 * | 7/2014 | Satou et al. | 347/9 |
| 2012/0236052 | A1 | 9/2012 | Tobita et al. | |
| 2012/0236080 | A1 | 9/2012 | Yoshida et al. | |
| 2012/0320118 | A1 | 12/2012 | Yokomaku | |

FOREIGN PATENT DOCUMENTS

| | | |
|---|---|---|
| JP | 11-309865 | 11/1999 |
| JP | 2000-085123 | 3/2000 |
| JP | 2000-516872 | 12/2000 |
| JP | 2006-224471 | 8/2006 |
| JP | 2010-173160 | 8/2010 |
| JP | 2011-062821 | 3/2011 |
| JP | 2012-192710 | 10/2012 |

* cited by examiner

*Primary Examiner* — An Do
(74) *Attorney, Agent, or Firm* — Duft Bornsen & Fettig LLP

(57) ABSTRACT

An image forming apparatus includes a liquid ejection head including a pressure generation unit configured to generate a pressure for pressurizing a liquid in an individual liquid chamber communicating nozzles; and a head drive control unit configured to generate a drive waveform including pulses in time series, select one or more pulses from the drive waveform according to a droplet size, and provide the selected drive pulses to the pressure generation unit. The drive waveform includes a first pulse not including a waveform component that suppresses ejection bending, and allowing a droplet to be ejected, and a second pulse including the waveform component that suppresses ejection bending, and allowing a droplet to be ejected. An amount of the droplet ejected in the second pulse is larger than in the first pulse, and a speed of the droplet ejected in the second pulse is higher than that in the first pulse.

7 Claims, 11 Drawing Sheets

IMAGE FORMING APPARATUS AND METHOD OF DRIVING AND CONTROLLING HEAD

CROSS-REFERENCE TO RELATED APPLICATION

The present application claims priority to and incorporates by reference the entire contents of Japanese Patent Application No. 2013-038320 filed in Japan on Feb. 28, 2013.

BACKGROUND OF THE INVENTION

1. Field of the Invention

The present invention relates to an image forming apparatus and a method of driving and controlling a head.

2. Description of the Related Art

As an image forming apparatus such as a printer, a facsimile machine, a copier, a plotter, or a combined machine thereof, an ink jet recording device is known, which is an image forming apparatus of a liquid ejection and recording system, using a liquid ejection head that ejects a liquid droplet as a recording head, for example.

Among such image forming apparatuses, an image forming apparatus is known, which includes a head drive control unit configured to generate a drive waveform including a plurality of drive pulses in time series, to select one, or two or more drive pulses from the drive waveform according to a droplet size, and to provide the selected drive pulses to a pressure generation unit.

In the liquid ejection head, a water repellant film is formed on a nozzle surface on which a nozzle for ejecting liquid droplets is formed in order to obtain a stable droplet ejection characteristic. However, when unevenness or deviation is caused in distribution of wettability in the vicinity of the nozzle, or an ink is solidified in the vicinity of the nozzle, due to abrasion or exfoliation of the water repellant film, a meniscus formed in the nozzle at meniscus oscillation becomes uneven, and the ink droplet ejected through the nozzle is more likely to bend.

Especially, immediately after a large droplet or a middle droplet having a large droplet size is ejected, the meniscus overflows in the vicinity of the nozzle, and the first liquid droplet ejected next tends to easily bend. When the droplet bending is generated, the image quality is decreased.

Therefore, conventionally, a configuration is known, in which an ejection pulse including a drive pulse that contributes to formation of a droplet having a plurality of droplet sizes is generated, a plurality of drive pulses that contributes to the formation of a droplet of a drive waveform includes a drive pulse including a waveform component that allows a pressure liquid chamber to be expanded and pulling in the meniscus in at least two stages just before allowing the pressure liquid chamber to be contacted and liquid droplets to be ejected, and the drive pulse has a time interval Is between an expansion start point of the pressure liquid chamber in a first stage and an expansion start point of the pressure liquid chamber in a second stage that satisfies a relationship of $0.3Tc \leq Ts \leq 0.7Tc$ (Japanese Laid-open Patent Publication No. 2011-062821).

Further, a configuration is known, which includes a waveform component that makes the droplet speed of a satellite droplet higher than that of a main droplet in order to reduce the satellite droplet (Japanese Laid-open Patent Publication No. 2012-192710).

However, including of a waveform component that suppresses ejection bending in all pulses makes the overall drive waveform length longer and high frequency driving difficult.

Therefore, to obtain a desired maximum drive frequency, it can be considered that a part of the pulses does not include the waveform component that suppresses the ejection bending.

However, when a plurality of pulses are sequentially provided, a plurality of droplets is ejected in order, and a large droplet is formed, a droplet ejected by a pulse not including a waveform component that suppresses the ejection bending has problems of being subject to influence of remaining oscillation by a pulse provided before the droplet is ejected, and falling in a state of easily bending.

Therefore, there is a need to suppress an increase in waveform length of a drive waveform while suppressing ejection bending, and to make high frequency driving possible.

SUMMARY OF THE INVENTION

It is an object of the present invention to at least partially solve the problems in the conventional technology.

According to an embodiment, there is provided an image forming apparatus that includes a liquid ejection head including a plurality of nozzles configured to eject a liquid droplet, an individual liquid chamber to which the nozzles communicate, and a pressure generation unit configured to generate a pressure for pressurizing a liquid in the individual liquid chamber; and a head drive control unit configured to generate a drive waveform including a plurality of pulses in time series, select one or more pulses from the drive waveform according to a droplet size, and provide the selected drive pulses to the pressure generation unit. The drive waveform at least includes a first pulse not including a waveform component that suppresses ejection bending, and allowing a droplet to be ejected, and following the first pulse, a second pulse including the waveform component that suppresses ejection bending, and allowing a droplet to be ejected. A droplet amount of the droplet ejected in the second pulse is larger than a droplet amount of the droplet ejected in the first pulse, and a droplet speed of the droplet ejected in the second pulse is higher than a droplet speed of the droplet ejected in the first pulse.

According to another embodiment, there is provided a method of driving and controlling a liquid ejection head that includes a plurality of nozzles configured to eject a liquid droplet, an individual liquid chamber to which the nozzles communicate, and a pressure generation unit configured to generate a pressure for pressurizing a liquid in the individual liquid chamber. The method includes generating a drive waveform including a plurality of pulses in time series; selecting one or more pulses from the drive waveform according to a droplet size; and providing the selected drive pulses to the pressure generation unit. The drive waveform at least includes a first pulse not including a waveform component that suppresses ejection bending, and allowing a droplet to be ejected, and following the first pulse, a second pulse including the waveform component that suppresses ejection bending, and allowing a droplet to be ejected. A droplet amount of the droplet ejected in the second pulse is larger than a droplet amount of the droplet ejected in the first pulse, and a droplet speed of the droplet ejected in the second pulse is higher than a droplet speed of the droplet ejected in the first pulse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
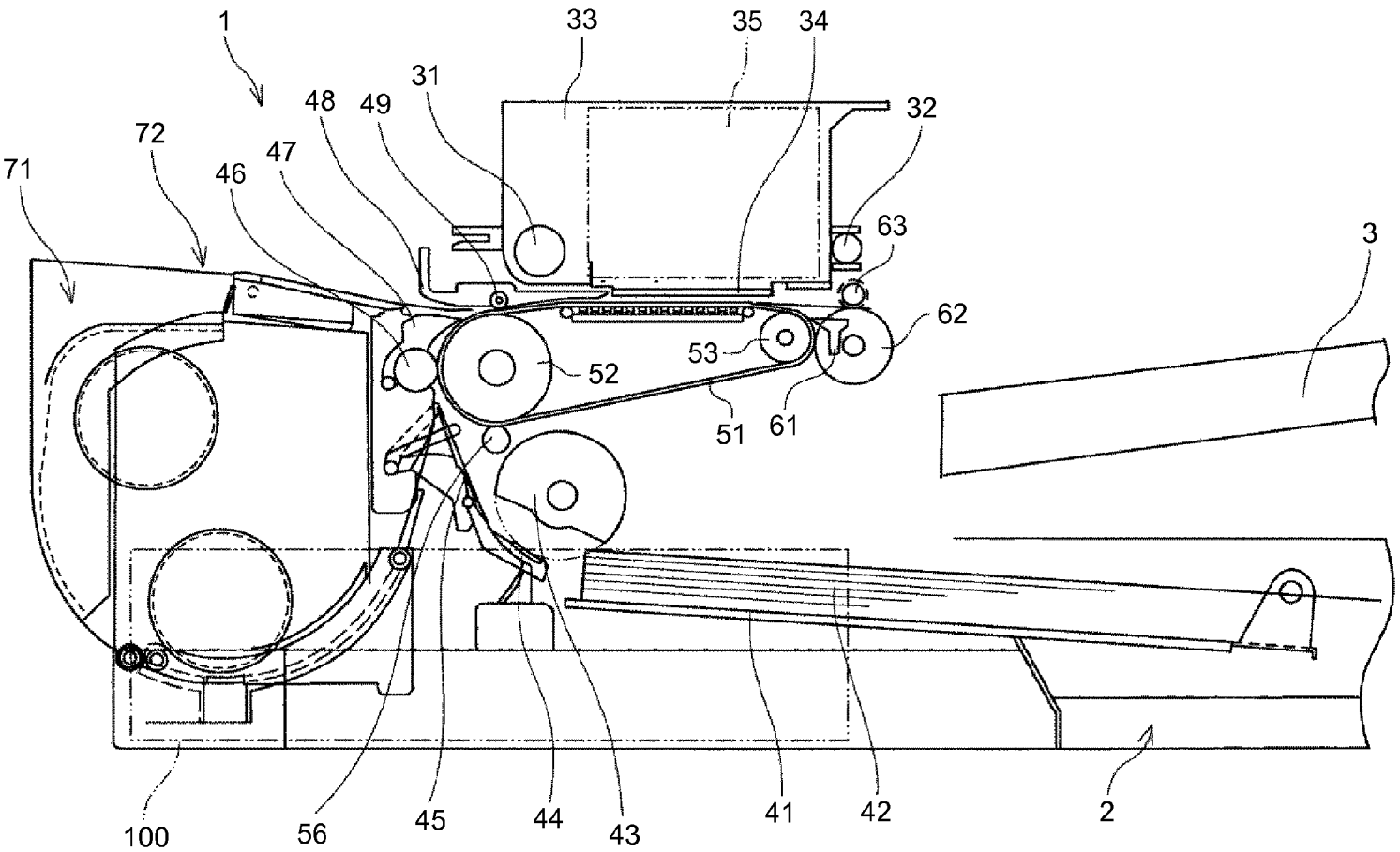
FIG. 1 is a side-surface schematic configuration diagram describing an overall configuration of a mechanism unit of an image forming apparatus according to the present invention.
Figure 2:
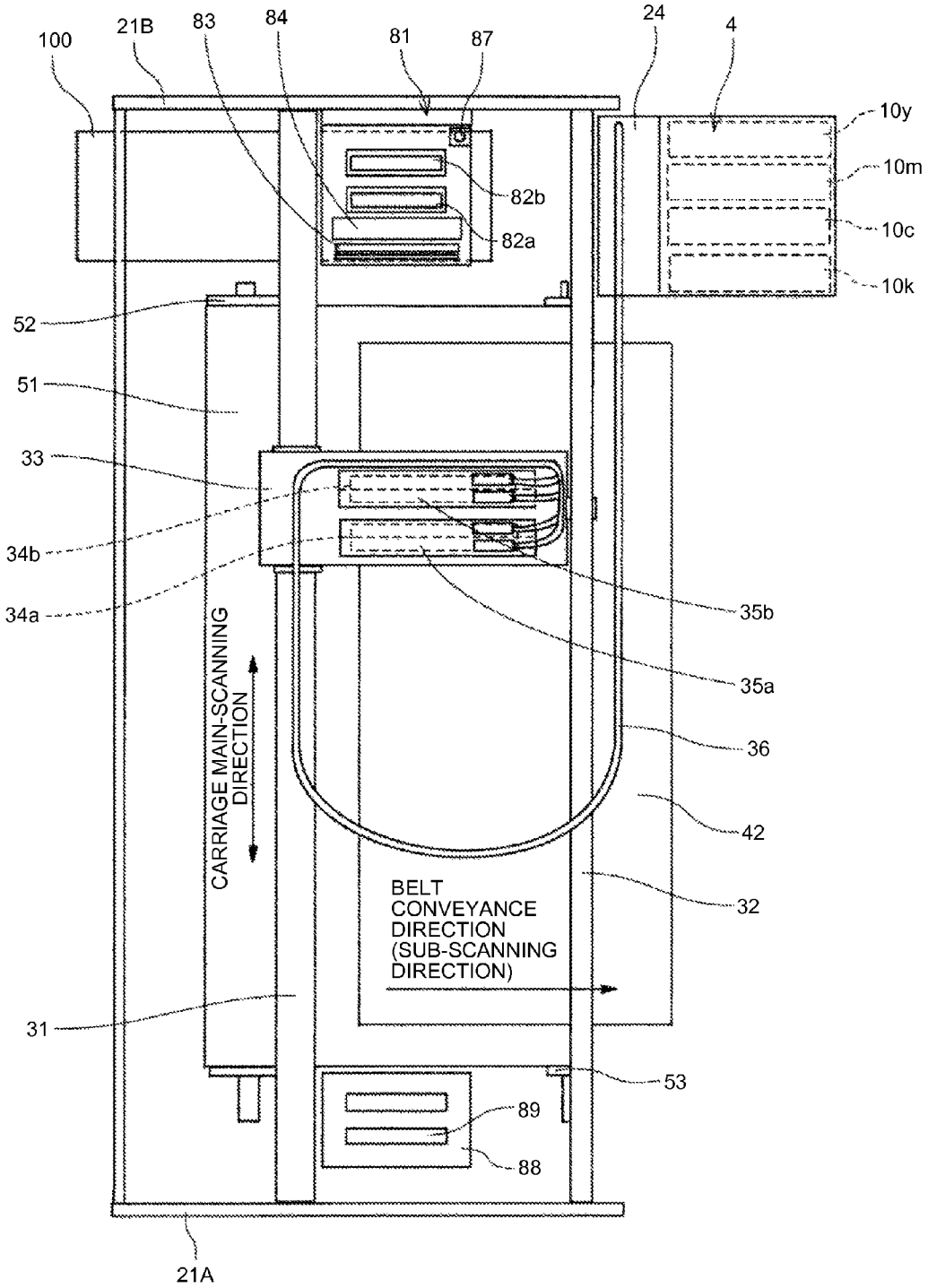
FIG. 2 is an explanatory plan view of essential parts of the mechanism unit.

Hereinafter, embodiments of the present invention will be described with reference to the appended drawings. First, an example of an image forming apparatus according to the present invention will be described with reference to FIGS. 1 and 2. Note that FIG. 1 is a side-surface explanatory diagram of the image forming apparatus, and FIG. 2 is an explanatory plan view of essential parts of the image forming apparatus.

The image forming apparatus is a serial-type inkjet recording device. A main guide rod 31 and a sub guide rod 32, which are guide members laterally bridging a left side plate 21A and a right side plate 21B of the main body of the image forming apparatus 1, hold a carriage 33 in a main-scanning direction in a freely slidable manner. The carriage 33 moves and performs scanning in the direction indicated by the arrow (carriage main-scanning direction) in FIG. 2 by a main-scanning motor (not illustrated) through a timing belt.

The carriage 33 includes recording heads 34*a* and 34*b* (which are referred to as "recording heads 34" when they are not distinguished. The same applies to other members), which include liquid ejection heads that eject yellow (Y) ink droplets, cyan (C) ink droplets, magenta (M) ink droplets, and black (K) ink droplets, respectively. In each of the recording heads 34, a nozzle line made of a plurality of nozzles is arranged in a sub-scanning direction perpendicular to the main-scanning direction, and is mounted such that an ink ejecting direction faces downward.

Each of the recording heads 34 includes two nozzle lines. In the recording head 34*a*, one of the two nozzle lines ejects the black (K) liquid droplets and the other nozzle line elects the cyan (C) liquid droplets. Further, in the recording head 34*b*, one of the two nozzle lines ejects the magenta (M) liquid droplets and the other nozzle line ejects the yellow (Y) liquid droplets. Note that, as the recording head 34, a recording head that includes nozzle lines corresponding to respective colors in which a plurality of nozzles are arranged on a single nozzle surface may be used.

Further, the carriage 33 includes head tanks 35*a* and 35*b* as a second ink supply unit for supplying respective colors corresponding to the nozzle lines of the recording heads 34. Meanwhile, ink cartridges (the main tanks) 10*y*, 10*m*, 10*c*, and 10*k* of respective colors are attached to a cartridge loading unit 4 in a freely detachable manner. Respective inks are supplied from the ink cartridges 10 to the head tanks 35 by a supply pump unit 24 through supply tubes 36 of respective colors.

Meanwhile, the image forming apparatus 1 includes, as a sheet feeding unit for feeding sheets 42 stacked on a sheet stacking unit 41 (a platen) of a sheet feeding tray 2, a semi-lunar roller (a sheet feeding roller) 43 that separates the sheets 42 from the sheet stacking unit 41 and feeds the separated sheet 42 one by one, and a separation pad 44 that faces the sheet feeding roller 43. The separation pad 44 is pressed toward the sheet feeding roller 43.

The image forming apparatus 1 includes a guide member 45 that guides the sheet 42, a counter roller 46, a conveyance guide member 47, and a pressing member 48 having a tip pressing roller 49, so as to forward the sheet 42 fed from the sheet feeding unit to a lower side of the recording head 34. Further, the image forming apparatus 1 includes a conveyance belt 51 as a conveyance unit that electrostatically attracts the fed sheet 42, and conveys the sheet 42 at a position facing the recording head 34.

The conveyance belt 51 is an endless belt. The conveyance belt 51 is put over a conveyance roller 52 and a tension roller 53, and rotationally moves in a belt conveyance direction (the sub-scanning direction). Further, the image forming apparatus 1 includes a charging roller 56 that is a charging unit for charging a surface of the conveyance belt 51. The charging roller 56 is arranged to be in contact with a surface of the conveyance belt 51, and driven and rotated by the rotation of the conveyance belt 51. The conveyance belt 51 is rotationally moved in the belt conveyance direction of FIG. 2 as the conveyance roller 52 is driven and rotated by a sub-scanning motor (not illustrated) through the timing.

Further, as a sheet discharging unit for discharging the sheet 42, which has been recorded by the recording head 34, the image forming apparatus 1 includes a separation claw 61 for separating the sheet 42 from the conveyance belt 51, a sheet discharging roller 62, and a spur 63 that is a sheet discharging roller. Further, the image forming apparatus 1 includes a sheet discharging tray 3 under the sheet discharging roller 62.

Further, a double-sided unit 71 is attached to a rear part of the main body of the image forming apparatus 1 in a freely detachable manner. The double-sided unit 71 takes in and reverses the sheet 42 that is returned by rotation of the conveyance belt 51 in a reverse direction, and feeds the sheet 42 between the counter roller 46 and the conveyance belt 51 again. Further, the upper surface of the double-sided unit 71 is a manual feeding tray 72.

Further, a maintenance and recovery mechanism 81 for maintenance and recovery states of the nozzles of the recording head 34 is arranged in a non-printing area on one side in the scanning direction of the carriage 33.

The maintenance and recovery mechanism 81 includes cap members (hereinafter, referred to as "cap") 82*a* and 82*b* (which are referred to as "cap 82" when they are not distinguished) for capping the nozzle surfaces of the recording head 34.

Further, the maintenance and recovery mechanism 81 includes a wiper member (wiper blade) 83 for wiping the nozzle surfaces, and an idle ejection receiver 84 that receives liquid droplets when idle ejection for ejecting liquid droplets that do not contribute to recording is performed in order to discharge a thickened recording liquid.

Further, the maintenance and recovery mechanism 81 includes a carriage lock 87 that locks the carriage 33. Further, at a lower side of the maintenance and recovery mechanism 81 of the recording head 34, a waste liquid tank 100 for storing a waste liquid generated by the maintenance and recovery operation is replaceably attached to the main body of the image forming apparatus 1.

Further, to discharge a thickened recording liquid during recording, an idle ejection receiver 88 that receives liquid droplets when idle ejection for ejecting liquid droplets that do not contribute to recording is performed is arranged at a non-printing area on the other side of the scanning direction of the carriage 33. The idle ejection receiver 88 includes an opening part 89 along the direction of the nozzle lines of the recording head 34, and the like.

In the image forming apparatus configured in such a manner, the sheets 42 are separated and fed one by one from the sheet feeding tray 2. The sheet 42, which has been fed approximately vertically upward, is guided by the guide 45, and is conveyed while being pinched between the conveyance belt 51 and the counter roller 46. Further, a tip of the sheet 42 is guided by a conveyance guide 37, and is pressed by the tip pressing roller 49 toward the conveyance belt 51. The conveyance direction of the sheet 42 is diverted by approximately 90 degrees.

At this time, the conveyance belt 51 is charged by the charging roller 56 by an alternating charging voltage pattern. When the sheet 42 is fed on the charged conveyance belt 51, the sheet 42 is adsorbed on the conveyance belt 51, and the sheet 42 is conveyed in the sub-scanning direction by the rotational movement of the conveyance belt 51.

Then, the recording head 34 is driven in accordance with an image signal while the carriage 33 is moved, so that the ink droplets are ejected onto the suspended sheet 42, and an amount corresponding to one line is recorded. After the sheet 42 is conveyed by a predetermined amount of conveyance, the next recording is performed. When a recording completion signal is received or a signal indicating that a rear end of the sheet 42 has reached the recording area is received, the recording operation is terminated, and the sheet 42 is discharged onto the sheet discharging tray 3.

Figure 3:
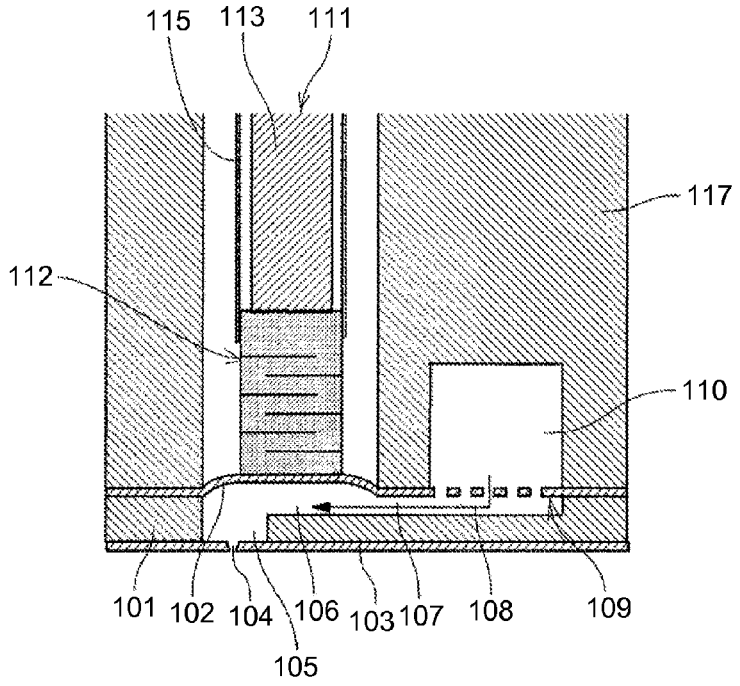
FIG. 3 is a cross-sectional explanatory diagram of a liquid chamber in a longitudinal direction, illustrating an example of a liquid ejection head that forms a recording head of the image forming apparatus.
Figure 4:
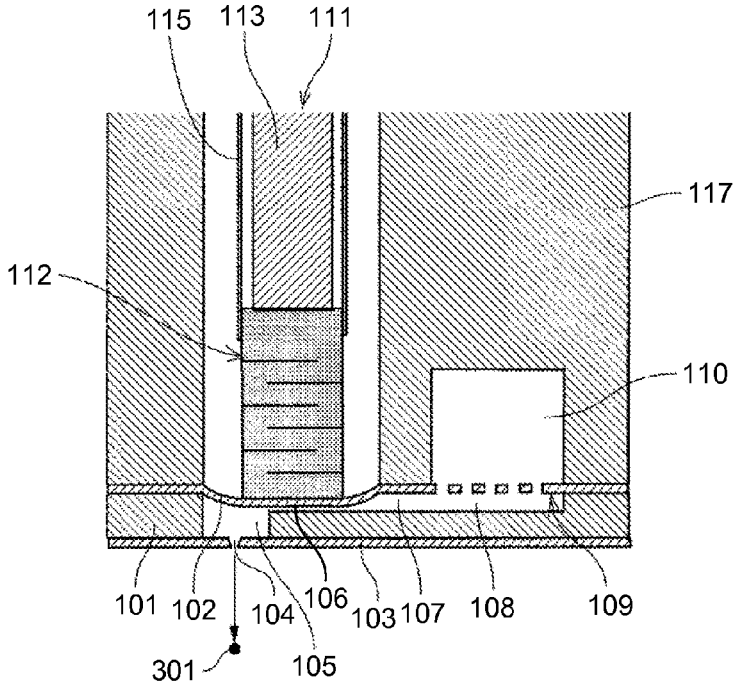
FIG. 4 is a cross-sectional explanatory diagram for describing a droplet ejection operation.

Next, an example of the liquid ejection head that forms the recording head 34 will be described with reference to FIGS. 3 and 4. Note that FIGS. 3 and 4 are cross-sectional explanatory diagrams along a longitudinal direction of the liquid chamber of the recording head 34 (a direction perpendicular to the nozzle arrangement direction).

The liquid ejection head joins a passage plate 101, an oscillation plate member 102, and a nozzle plate 103. Accordingly, an individual liquid chamber 106 to which a nozzle 104 that ejects liquid droplets communicates through a through hole 105, a fluid resistance unit 107 that supplies a liquid to the individual liquid chamber 106, and a liquid introduction unit 108. An ink is introduced from a common liquid chamber 110 formed in a frame member 117 to the liquid introduction unit 108 through a filter unit 109 formed in the oscillation plate member 102, and is supplied from the liquid introduction unit 108 to the individual liquid chamber 106 through the fluid resistance unit 107. Note that the "individual liquid chamber" has a meaning that includes a pressurizing chamber, a pressurizing liquid chamber, a pressure chamber, an individual passage, a pressure generation chamber, and the like.

The passage plate 101 forms opening parts and groove parts such as the through hole 105, the individual liquid chamber 106, the fluid resistance unit 107, and the liquid introduction unit 108 by lamination of metal plates such as SUS. The oscillation plate member 102 serves as a wall surface member that forms a wall surface of the liquid chamber 106, the fluid resistance unit 107, the liquid introduction unit 108, and the like, and also serves as a member that forms the filter unit 109. Note that the passage plate 101 is not limited to be formed using a metal plate such as SUS, and may be able to be formed by anisotropic etching of a silicon substrate.

A columnar laminated piezoelectric member 112 as an actuator unit (pressure generation unit) that generates energy, which pressurizes an ink in the individual liquid chamber 106 and ejects the liquid droplets through the nozzle 104 over a surface of the oscillation plate member 102 on a side opposite to the liquid chamber 106, is joined. One end part of the piezoelectric member 112 is joined to a base member 113, and an FPC 115 that transmits a drive waveform is connected to the piezoelectric member 112. These members form a piezoelectric actuator 111.

Note that, in this example, the piezoelectric member 112 is used in a d33 mode in which the piezoelectric member 112 is expanded/contracted in a laminating direction. However, a d31 mode may be used, in which the piezoelectric member 112 is expanded/contracted in a direction perpendicular to the laminating direction.

In a liquid ejection head configured as described above, the piezoelectric member 112 is contracted by decreasing a voltage applied to the piezoelectric member 112 from a reference potential Ve, the oscillation plate member 102 is transformed, and the volume of the individual liquid chamber 106 is expanded, as illustrated in FIG. 3. Accordingly, an ink flows in the individual liquid chamber 106.

Following that, as illustrated in FIG. 4, the voltage applied to the piezoelectric member 112 is increased, the piezoelectric member 112 is extended in the laminating direction, and the oscillation plate member 102 is transformed in a direction of the nozzle 104, so that the volume of the individual liquid chamber 106 is contracted. Accordingly, the ink in the individual liquid chamber 106 is pressurized, and a liquid droplet 301 is ejected through the nozzle 104.

Then, the oscillation plate member 102 is restored to an initial position by returning the voltage applied to the piezoelectric member 112 to the reference potential Ve, and the liquid chamber 106 is expanded to generate a negative pressure. At this time, the ink is filled up in the liquid chamber 106 from the common liquid chamber 110. At this point, after the oscillation of the meniscus surface of the nozzle 104 is attenuated and stabled, the operation is moved onto an operation of ejecting next liquid droplets.

Figure 5:
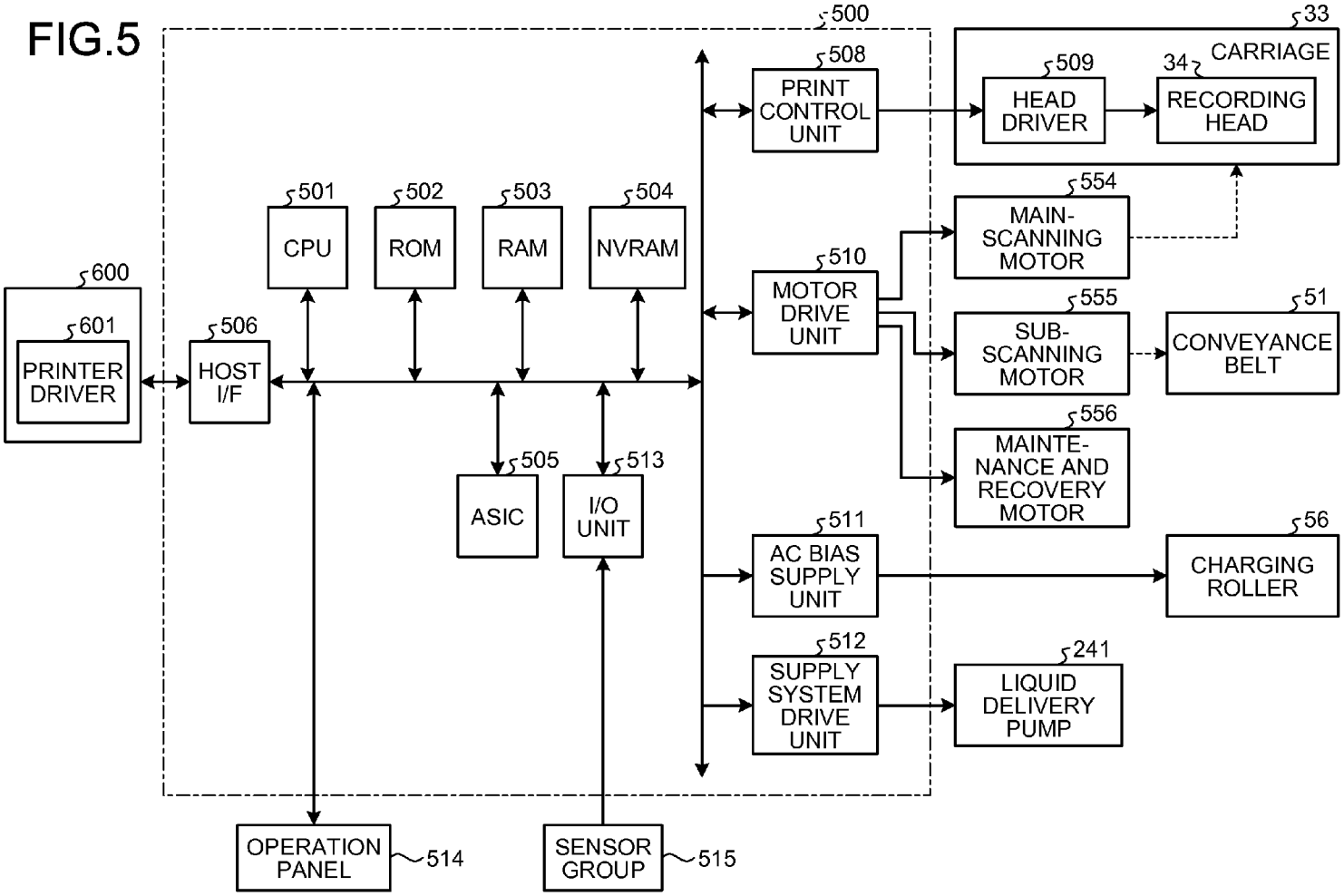
FIG. 5 is an explanatory block diagram illustrating an outline of a control unit of the image forming apparatus.

Next, an outline of a control unit of the image forming apparatus will be described with reference to FIG. 5. Note that FIG. 5 is an explanatory block diagram of a control unit of the image forming apparatus.

A control unit 500 includes a CPU 501 that controls the entire image forming apparatus, a ROM 502 that stores fixed data such as various programs including a programs executed by the CPU 501, and a RAM 503 that temporarily stores image data and the like. Further, the control unit 500 includes a rewritable non-volatile memory 504 for holding data while the power supply of the apparatus is cut off, and an ASIC 505 that performs various types of signal processing with respect to image data, image processing such as rearrangement, and processing of an input/output signal for controlling the entire apparatus.

Further, the control unit 500 includes a print control unit 508 that includes a data transfer unit and a drive signal generation unit for driving and controlling the recording head 34, and a head driver (driver IC) 509 for driving the recording head 34 provided at the carriage 33 side. Further, the control unit 500 includes a main-scanning motor 554 that moves and scans the carriage 33, a sub-scanning motor 555 that rotationally moves the conveyance belt 51, a motor drive unit 510 for driving a maintenance and recovery motor 556 that moves the cap 82 and the wiper member 83 of the maintenance and recovery mechanism 81 and performs a suction pump 812, and the like. Further, the control unit 500 includes an AC bias supply unit 511 that supplies an AC bias to the charging roller 56, a supply system drive unit 512 that drives a liquid delivery pump 241, and the like.

Further, an operation panel 514 for inputting and displaying information necessary for the apparatus is connected to the control unit 500.

The control unit 500 further includes a host I/F 506 for transmitting/receiving signals to/from a host side, and receives signals from the host 600 side such as an information processing device including a personal computer, an image reading device, or an imaging device using the I/F 506 through a cable or a network.

The CPU 501 of the control unit 500 reads out and analyzes print data stored in a reception buffer included in the host I/F 506, performs image processing and data rearrangement processing necessary in the ASIC 505, and transfers the image data from the print control unit 508 to the head driver 509. Note that dot pattern data for outputting an image may be generated by a printer driver 601 at the host 600 side or may be generated by the control unit 500.

The print control unit 508 transfers the above-described image data as serial data, and outputs, to the head driver 509, a transfer clock signal, a latch signal, and a control signal necessary for transferring the image data and confirming the transfer of the image data. Further, the print control unit 508 includes a drive signal generation unit that includes a D/A convertor that converts pattern data of a drive pulse stored in the ROM 502, a voltage amplifier, a current amplifier, and the like. The print control unit 508 generates a drive waveform formed of a single drive pulse or a plurality of drive pulses, and outputs the drive waveform to the head driver 509.

The head driver 509 selects the drive pulses that form the drive waveform provided from the print control unit 508 and provides the drive pulses to the piezoelectric member 112 that is a pressure generation unit of the recording head 34 based on the image data corresponding to one line serially input to the recording head 34. Accordingly, the head driver 509 drives the recording head 34. At that time, the head driver 509 can distinguish and eject dots having different sizes, such as a large droplet, a middle droplet, and a small droplet, by selecting a part of or all of the drive pulses that form the drive waveform, or by selecting a part or all of waveform components that form a pulse.

An I/O unit 513 obtains information from a sensor group 515 that includes various sensors attached to the image forming apparatus 1, extracts information necessary for control of the printer, and uses the extracted information for control of the print control unit 508, the motor drive unit 510, and the AC bias supply unit 511. The sensor group 515 includes an optical sensor for detecting a position of a sheet, a thermistor for monitoring a temperature inside the image forming apparatus 1, a sensor for monitoring a voltage of a charged belt, and an interlock switch for detecting opening and closing of a cover. The I/O unit 513 can process various types of sensor information.

Figure 6:
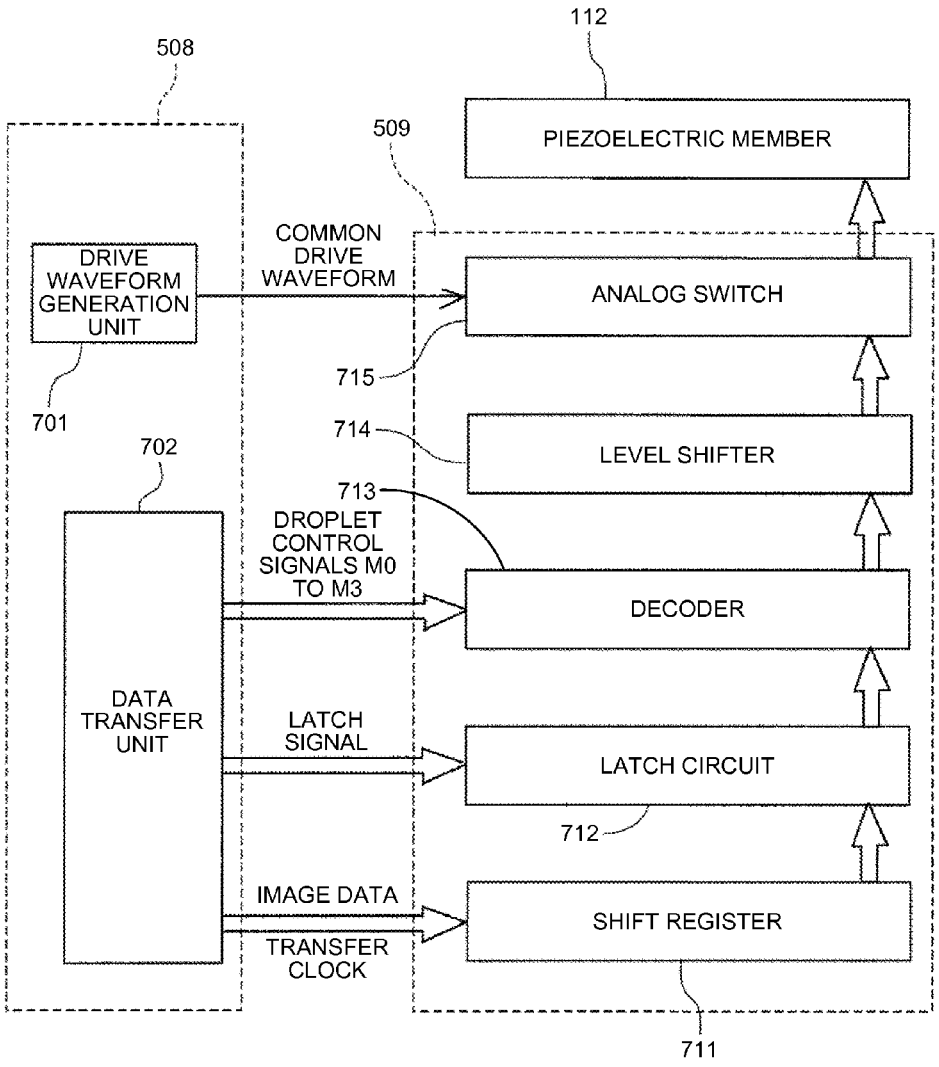
FIG. 6 is an explanatory block diagram illustrating examples of a print control unit and a head driver of the control unit.

Next, examples of the print control unit 508 and the head driver 509 will be described with reference to FIG. 6.

The print control unit 508 includes a drive waveform generation unit 701 and a data transfer unit 702. The drive waveform generation unit 701 generates and outputs a drive waveform (a common drive waveform) formed of a plurality of pulses (drive signals) in a single print period (a single drive period) during image formation. The data transfer unit 702 outputs two-bit image data (tone signals: 0, 1) corresponding to a print image, the clock signal, the latch signal (LAT), and droplet control signals M0 to M3 during the image formation.

Note that the droplet control signal is a two-bit signal that instructs opening or closing of an analog switch 715 that is a switch unit of the head driver 509 described below in each droplet. A state of the droplet control signal is made transition to an H-level (ON) with a pulse or a waveform component to be selected in synchronization with a print period of the common drive waveform, and is made transition to an L-level (OFF) when a pulse or a waveform component is not selected.

The head driver 509 includes a shift register 711 that inputs the transfer clock (shift clock) and serial image data (tone data: two bits per one channel (one nozzle)) from the data transfer unit 702. Further, the head driver 509 includes a latch circuit 712 for latching registered values of the shift register 711 by latch signals. Further, the head driver 509 includes a decoder 713 that decodes tone data and the droplet control signals M0 to M3 and outputs a result, and a level shifter 714 that converts a logic level voltage signal of the decoder 713 to a level in which the analog switch 715 is operable. Further, the head driver 509 includes the analog switch 715 that is turned ON/OFF (opened/closed) by an output of the decoder 713 provided through the level shifter 714.

The analog switch 715 is connected to a selective electrode (individual electrode) of each piezoelectric member 112, and a common drive waveform Pv from the drive waveform generation unit 701 is input. Therefore, the analog switch 715 is turned ON in accordance with a result of decoding of the serially transferred image data (the tone data) and the droplet control signals M0 to M3 in the decoder 713. When the analog switch 715 is turned ON, a desired pulse (or waveform component) that forms the common drive waveform Pv passes through (or is selected) and is applied to the piezoelectric member 112.

Figure 7:
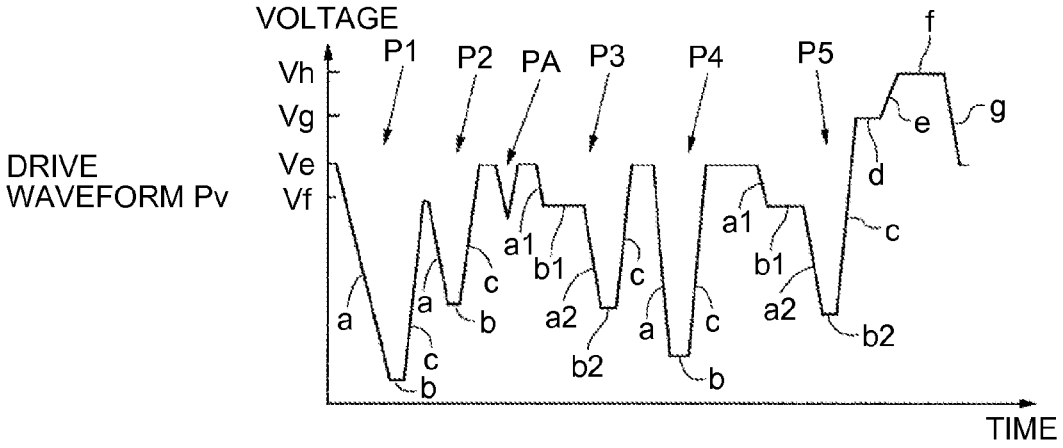
FIG. 7 is an explanatory diagram describing a drive waveform in a first embodiment of the present invention.

Next, the drive waveform in the first embodiment of the present invention will be described with reference to FIG. 7. FIG. 7 is an explanatory diagram describing the drive waveform.

Note that a "pulse" is used as a term that indicates a drive pulse as a component that forms a drive waveform. An "ejection pulse" is used as a term that indicates a drive pulse applied to the pressure generation unit and ejecting the liquid droplets. Further, a "non-ejection pulse" is used as a term that indicates a drive pulse (faint drive pulse) applied to but drives the pressure generation unit to the degree not to eject a droplet (to the degree to cause the ink in the nozzles to flow). Further, the drive waveform and the pulse as a component thereof to be described below are examples and are not limited to the examples.

The present embodiment is an example of a drive waveform that allows liquid droplets having three sizes (a large droplet, a middle droplet, and a small droplet) to be ejected. The drive waveform (common drive waveform) Pv as illustrated in FIG. 7 is output from the drive waveform generation unit 701. The drive waveform Pv is a waveform in which drive pulses P1 to P5 that serve as ejection pulses to allow liquid droplets to be ejected are generated in time series in a single print period (a single drive period), and faint drive pulse PA is sandwiched between the drive pulse P2 and the drive pulse P3.

A waveform component of each of the drive pulses P1 to P5 is as follows.

The drive pulse P1 is formed of a waveform component (an expanding waveform component or a pulling-in waveform component) a that falls from the reference potential Ve to a predetermined hold potential and allows the individual liquid chamber 106 to be expanded, a waveform component (holding waveform component) b that holds the potential that has fallen (hold potential), and a waveform component (a contracting waveform component or a pressing waveform component) c that rises from the hold potential to an intermediate potential Vf that is lower than the reference potential Ve and allows the individual liquid chamber 106 to be contracted. Note that the hold potential means a potential at which the drive pulse allows the individual liquid chamber 106 to be expanded most (it is not limited that the drive pulses take the same potential).

The waveform component a of the drive pulse P1 has a large constant at falling, and is a waveform component that gradually falls to the hold potential and suppresses ejection bending.

The drive pulse P2 is formed of a waveform component (an expanding waveform component or a pulling-in waveform component) a that falls from the intermediate potential Vf to a predetermined hold potential and allows the individual liquid chamber 106 to be expanded, a waveform component (a holding waveform component) b that holds the potential that has fallen (hold potential), and a waveform component (a contracting waveform component or a pressing waveform component) c that rises from the hold potential to the reference potential Ve and allows the individual liquid chamber 106 to be contracted.

The drive pulse P3 is formed of a waveform component (an expanding waveform component or a pulling-in waveform component) a1 that falls from the reference potential Ve to the intermediate potential Vf and allows the individual liquid chamber 106 to be expanded, a waveform component (a holding waveform component) b1 that holds the intermediate potential Vf, a waveform component (an expanding waveform component or a pulling-in waveform component) a2 that falls from the intermediate potential Vf to the hold potential and allows the individual liquid chamber 106 to be expanded, and a waveform component (a contracting waveform component or a pressing waveform component) c that rises from the hold potential to the reference potential Ve and allows the individual liquid chamber 106 to be contracted.

The waveform components a1, b1, and a2 of the drive pulse P3 performs two-stage pulling-in (two-stage expansion), and is a waveform component that suppresses the ejection bending. This point will be described below.

The drive pulse P4 is formed of a waveform component (an expanding waveform component or a pulling-in waveform component) a that falls from the reference potential Ve to the predetermined hold potential and allows the individual liquid chamber 106 to be expanded, a waveform component (a holding waveform component) b that holds the potential that has fallen (hold potential), and a waveform component (a contracting waveform component or a pressing waveform component) c that rises from the hold potential to the reference potential Ve and allows the individual liquid chamber 106 to be contracted.

This drive pulse P4 is a first pulse in the present invention, and is a pulse not including a waveform component that suppresses the ejection bending.

The drive pulse P5 is formed of an expanding waveform component a1 that falls from the reference potential Ve to the intermediate potential Vf and allows the individual liquid chamber 106 to be expanded, a holding component b1 that holds the intermediate potential Vf, an expanding waveform component a2 that falls from the intermediate potential Vf to the hold potential and allows the individual liquid chamber 106 to be expanded, a holding component b2 that holds the hold potential, a contracting waveform component c that rises from the hold potential to a potential Vg while exceeding the reference potential Ve and allows the individual liquid chamber 106 to be contracted, a holding component d that holds the rising potential of the waveform component c, a contracting waveform component e that further rises from the potential held in the holding component d to a potential Vh and allows the individual liquid chamber 106 to be contracted, a holding component f that holds the rising potential Vh of the contracting waveform component e, and a waveform component g that falls from the held potential Vh of the holding component f to the reference potential Ve.

The drive pulse P5 is a second pulse in the present invention, which includes the waveform component that suppresses the ejection bending, following the drive pulse P4 that is the first pulse of the present invention, which does not includes the waveform component that suppresses the ejection bending.

Figure 8:
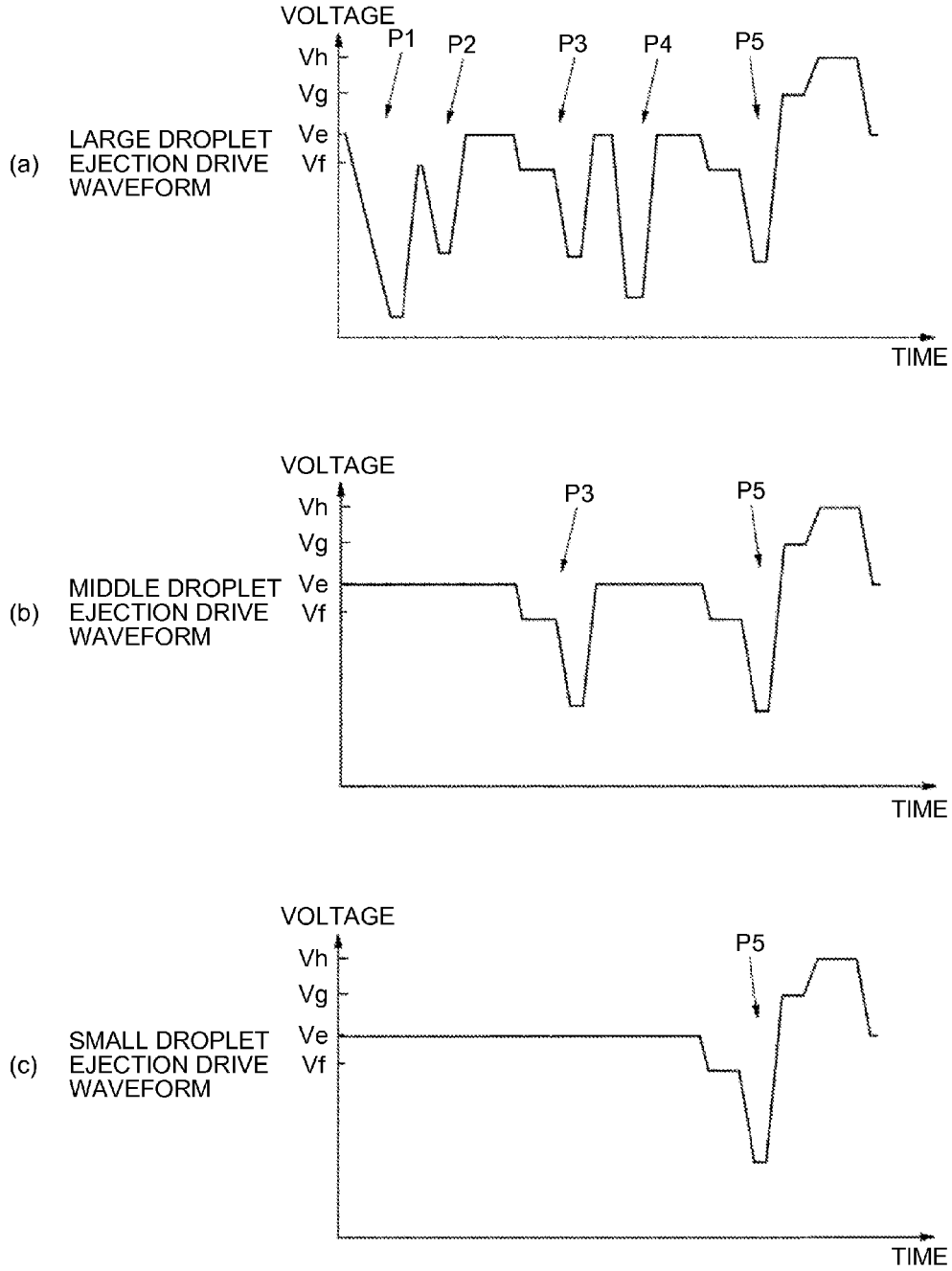
FIG. 8 illustrates drive waveforms generated from the drive waveform.

When the waveform component or the drive pulse of the drive waveform Pv is selected by the droplet control signals M0 to M3 output from the data transfer unit 702, waveforms provided to the pressure generation unit serves as a large droplet ejection drive waveform, a middle droplet ejection drive waveform, a small droplet ejection drive waveform, or a faint drive waveform, as illustrated in FIG. 8, accordingly.

That is, the large droplet ejection drive waveform is, as illustrated in (a) of FIG. 8, a waveform in which all of the drive pulses P1 to P5 are selected. The drive pulse P1 that is a first pulse of the large droplet ejection drive waveform is a pulse that includes a waveform component that suppresses the ejection bending, and in which the constant at falling is large, as described above.

Further, the middle droplet ejection drive waveform is, as illustrated in (b) of FIG. 8, a waveform in which the drive pulses P3 and P5 are selected. The drive pulse P3 that is a first pulse of the middle droplet ejection drive waveform is a pulse including a waveform component that suppresses the ejection bending by the two-stage pulling-in, as described above.

Further, the small droplet ejection drive waveform is, as illustrated in (c) of FIG. 8, a waveform in which the drive pulse P5 is selected. The drive pulse P5 that is a first pulse of the small droplet ejection drive waveform is a pulse including a waveform component that suppresses the ejection bending by the two-stage pulling-in, as described above.

That is, when one, or two or more pulses from the drive waveform Pv are selected and are provide to the pressure generation unit according to the droplet size, a liquid droplet having a desired droplet size is formed.

Figure 9:
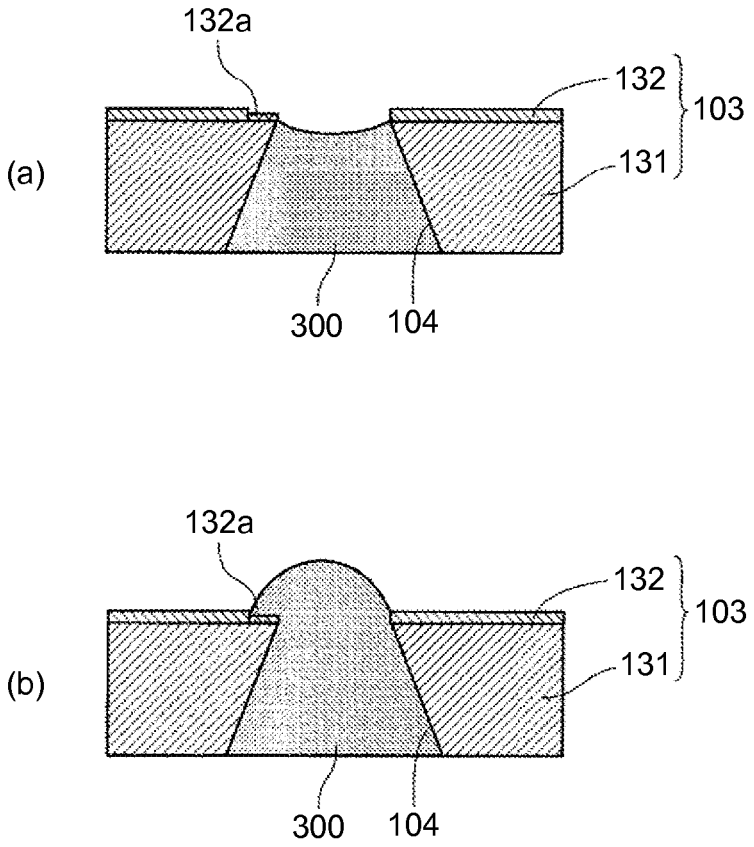
FIG. 9 illustrates deterioration of a water repellant film and overflow of meniscus in a nozzle part.

Here, for describing a suppression action of the ejection bending by the two-stage pulling-in, the deterioration of the water repellant film and the overflow of the meniscus will be described with reference to FIG. 9. FIG. 9 illustrates the nozzle part used for the description.

First, as illustrated in (a) of FIG. 9, the nozzle plate 103 has a water repellant film 132 formed on a surface of a nozzle base material 131. The water repellant film 132 is deteriorated due to abrasion by wiping in the maintenance and recovery operation over time, and a deteriorated part (deteriorated water repellant film) 132*a* is caused around the nozzle 104.

In this case, in theory, the meniscus of the ink 300 is formed in the nozzle 104 in a normal static state, as illustrated in (a) of FIG. 9, and forms a bridge on a liquid chamber side based on a nozzle edge. Influence of the deterioration of the water repellant film is small.

However, as illustrated in (b) of FIG. 9, when a state in which the ink protrudes toward an outside of the nozzle 104 is caused, such as overflow of the meniscus after the droplet ejection or immediately after high frequency driving, the meniscus is formed into an asymmetrical shape with respect to the nozzle center due to the deteriorated water repellant film 132*a*.

Note that the overflow of the meniscus after the droplet ejection refers to a phenomenon in which, when the liquid droplets are ejected, the ink inflow speed from the common liquid chamber 110 with respect to outflow from the flow ink nozzle 104 does not become stable soon, and therefore, overflow of the meniscus in the nozzle 104 is caused with momentum.

Especially, a waveform that ejects a larger droplet in a single print period (a waveform having a larger ejection amount per unit time) causes larger overflow of the meniscus. Further, the "overflow of the meniscus immediately after high frequency driving" refers to a phenomenon in which the ink inflow speed from the common liquid chamber 110 generated in association with the outflow of a large amount of ink through the nozzle due to the high frequency driving does not becomes stable soon, and causes the overflow of the meniscus of the nozzle 104 with momentum. This is a phenomenon having a refill period Rf different from a unique oscillation period Tc of the individual liquid chamber.

Figure 10:
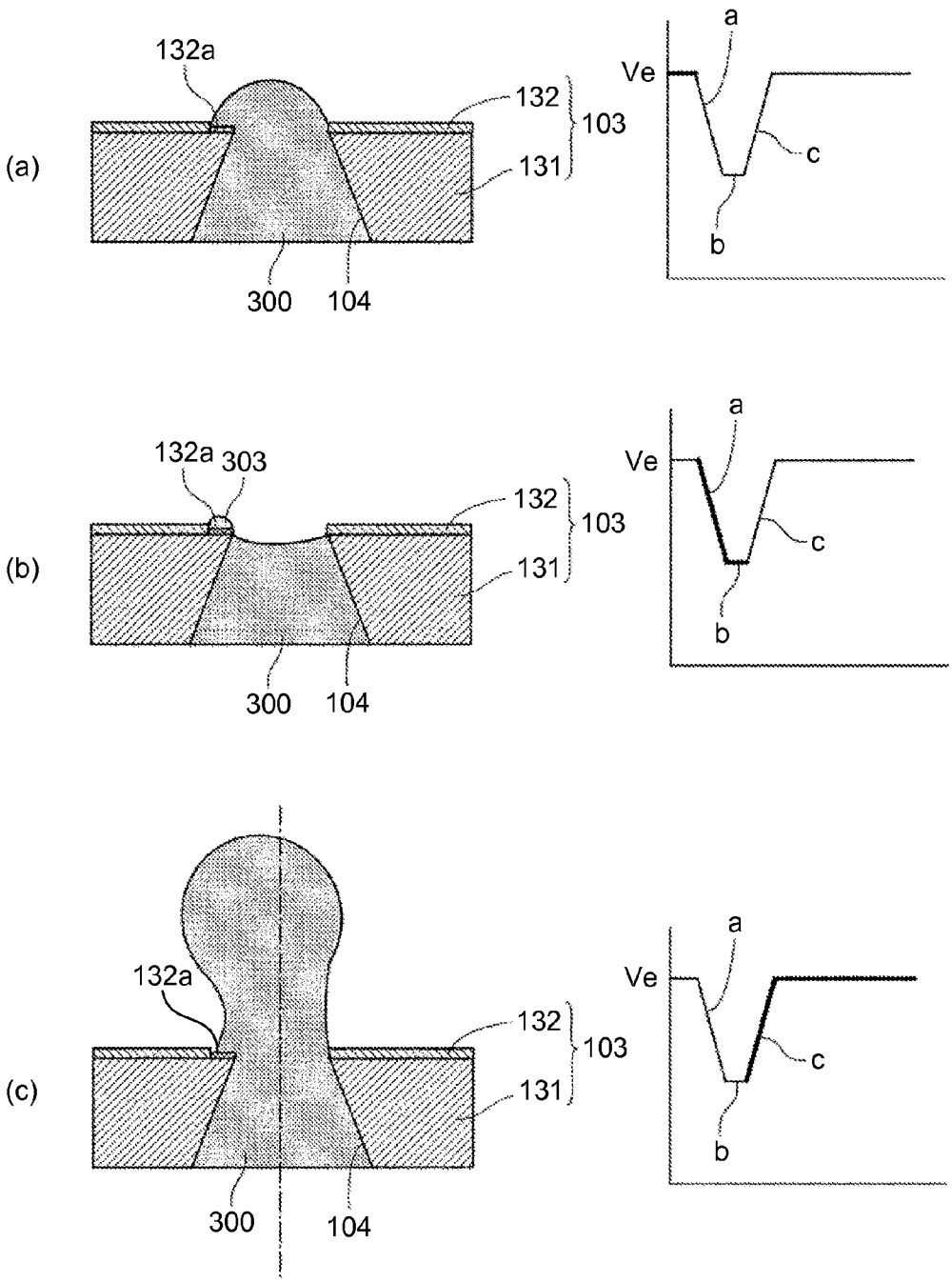
FIG. 10 illustrates ejection bending in a drive pulse not including a waveform component that suppresses the ejection bending in a nozzle part.

Next, the ejection bending in the drive pulse (the drive pulse P4) not including a waveform component that suppresses the ejection bending will be described with reference to FIG. 10. FIG. 10 illustrates the ejection bending and explanatory diagrams of the drive pulses in the nozzle part.

The drive pulse P4 performs, as illustrated in the right side parts of (a) to (c) of FIG. 10, a first-stage pulling-in (first-stage expansion) to the hold potential with the pulling-in waveform component a, and performs contraction of a liquid chamber with the contracting waveform component c through the holding waveform component b. Note that, in (a) to (c) of FIG. 10, the waveform parts of the drive pulses with respect to the states of the nozzle meniscus in the left side parts are illustrated by the thick lines.

In a case where the drive pulse is used, when the individual liquid chamber 106 is expanded by the pulling-in waveform component a of the drive pulse, as illustrated in (b) of FIG. 10 in a state where the overflow of the meniscus has been caused, as illustrated in (a) of FIG. 10, the meniscus is pulled in the nozzle 104. At this time, a part of the ink 303 remains in the deteriorated part of the water repellant film 132*a*.

From this state, when the individual liquid chamber 106 is contracted by the contracting component (pressing waveform component) c of the drive pulse, as illustrated in (c) of FIG. 10, the meniscus is pushed out. At this time, the liquid droplet is formed from a state in which the meniscus is in an asymmetrical state with respect to the nozzle center. Therefore, the ejection bending is caused.

Figure 11:
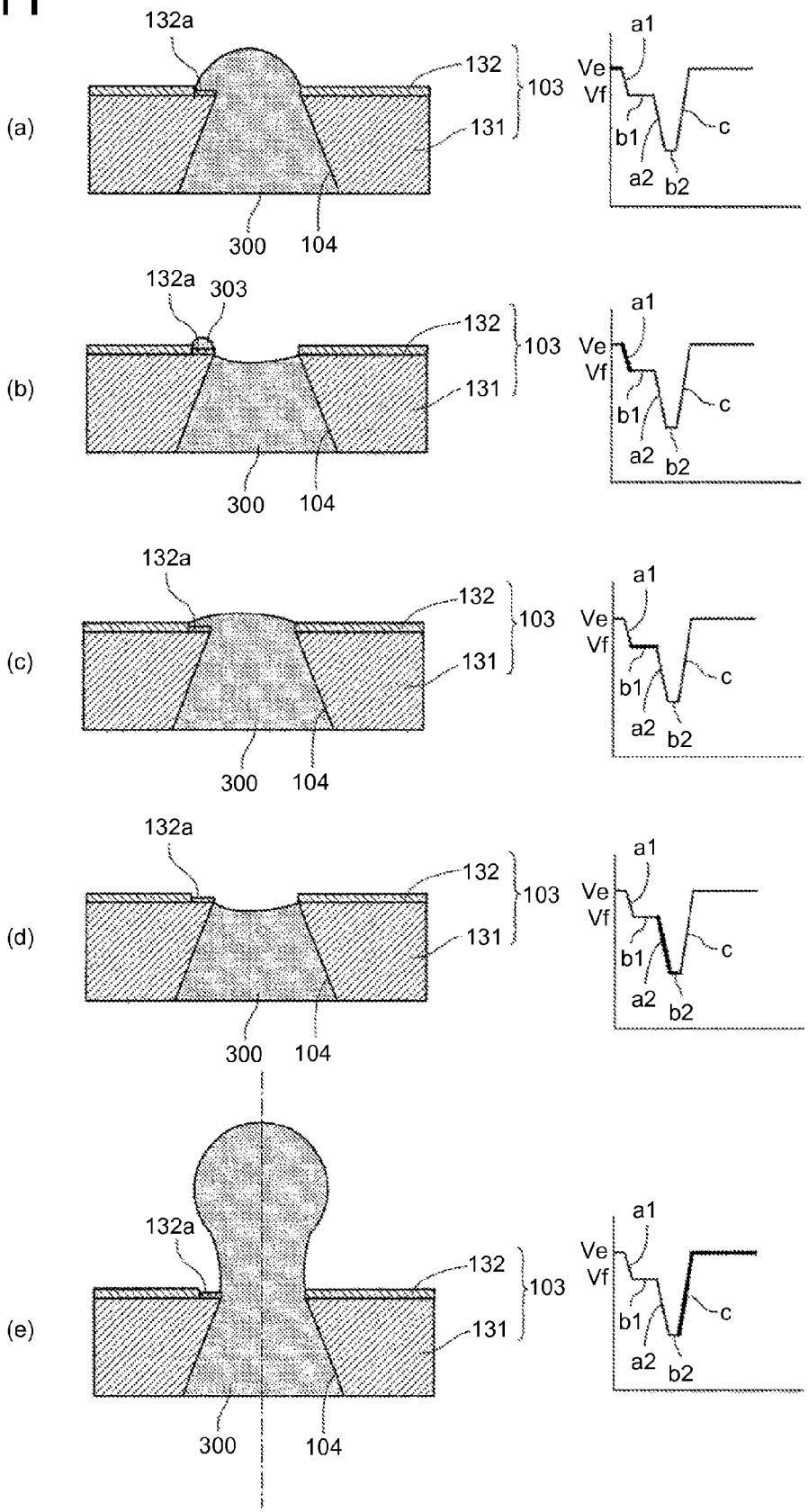
FIG. 11 illustrates suppression of the ejection bending by a drive pulse including the waveform component that suppresses the ejection bending.

Next, suppression of the ejection bending by the drive pulses (P3 and P5) including a waveform component that suppresses the ejection bending will be described with reference to FIG. 11. In FIG. 11, (a) to (e) each illustrate the nozzle part when the drive pulse waveforms are provided and the drive pulse according to the present embodiment. Note that, in (a) to (e) of FIG. 11, the waveform parts of the drive pulses with respect to the state of the nozzle meniscus in the left side parts are illustrated by the thick lines.

In this case, when the individual liquid chamber 106 is expanded by the expanding waveform component a1, as illustrated in (b) of FIG. 11 in a state where the overflow of the meniscus has been caused, as illustrated in (a) of FIG. 11, the meniscus is pulled in the nozzle 104. At this time, a part of the ink 303 remains in the deteriorated part of the water repellant film 132*a*.

However, as illustrated in (c) of FIG. 11, swinging back (an amplitude) of the meniscus is cased between the first pulling-in waveform component a1 and the holding waveform component b1, and the ink in the nozzle 104 and the remaining ink 303 are combined.

Therefore, as illustrated in (d) of FIG. 11, when the individual liquid chamber 106 is expanded by the expanding waveform component a2, the remaining ink 303 is pulled in the nozzle 104, and the meniscus becomes to have a symmetrical shape with respect to the nozzle center.

From this state, when the individual liquid chamber 106 is contracted by the contracting waveform component c, the meniscus is pushed out and the liquid droplet is ejected, as illustrated in (e) of FIG. 11. At this time, since the meniscus has a symmetrical shape with respect to the nozzle center, the ejection bending is not caused.

As described above, the two-stage pulling-in of the meniscus (two-stage expansion of the individual liquid chamber) is performed, whereby the ejection bending can be suppressed.

Figure 12:
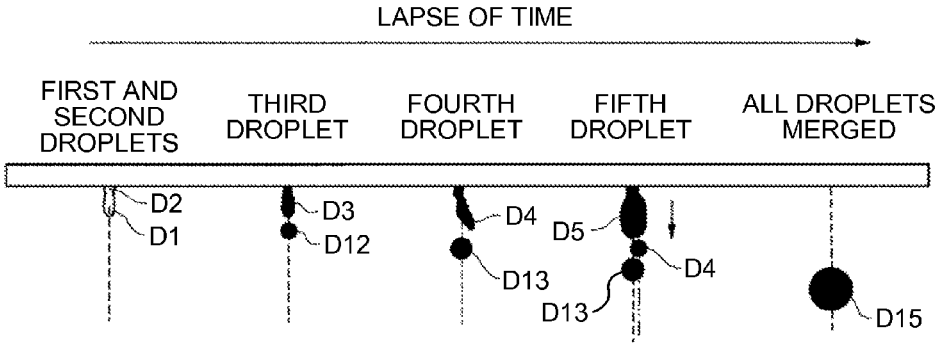
FIG. 12 is an explanatory diagram describing merging of large droplets formed in a large droplet ejection drive waveform in the first embodiment.

The large droplet ejection drive waveform in the first embodiment will also be described with reference to FIG. 12. Note that FIG. 12 is an explanatory diagram describing merging of ejected droplets at formation of a large droplet in the first embodiment. Further, in the present embodiment, the maximum drive frequency is 24 kHz. Therefore, the waveform length of the drive waveform is 37.1 μm or less.

First, when the drive pulses P1 and P2 are provided, first and second droplets D1 and D2 are ejected. At this time, the drive pulse P1 has a longer time to pull in the meniscus than other drive pulses P2 and P5 that eject subsequent droplets to the first droplet D1 (the constant at falling of the expanding waveform component a is larger).

As described above, slowly pulling-in the meniscus has an effect to suppress excessive oscillation of the meniscus. Therefore, the ejection bending can be prevented, and similar effects to the above-described two-stage meniscus pulling-in can be obtained.

Here, following that, when the drive pulse P3 is provided in a state where the first and second droplets D1 and D2 are combined to become a droplet D12, a third droplet D3 is ejected. The drive pulse P3 is, as described above, a pulse including a waveform component that performs the second-stage meniscus pulling-in. Accordingly, influence of remaining oscillation of the meniscus generated due to the ejection of the first and second droplets can be reduced, and the third liquid droplet D3 having rectilinearity can be ejected.

Then, the droplet D3 is combined with the preceding droplet D12 to become a droplet D13.

Next, when the drive pulse P4 is provided, a fourth droplet D4 is ejected. The drive pulse P4 is, as described above, a pulse not including a waveform component that suppresses the ejection bending. Therefore, the drive pulse P4 is subject to the influence of the remaining oscillation associated with the preceding droplet ejection, and the ejection bending is caused in the droplet D4.

In theory, it is favorable to include the waveform component that suppresses the ejection bending in the drive pulse P4. However, the waveform length of the drive waveform becomes longer, and the maximum drive frequency is reduced. Therefore, the drive pulse P4 is a pulse not including the waveform component that suppresses the ejection bending.

Finally, when the drive pulse P5 is provided, a fifth droplet D5 is ejected.

The drive pulse P5 is, as described above, a pulse that performs the two-stage pulling-in, and the ejection bending is suppressed and the rectilinearity of the ejected droplet D5 is enhanced.

Further, the drive pulse P5 performs the two-stage meniscus pulling-in, in which the first-stage pushing voltage by the contracting waveform component c is the potential Vg that is higher than the intermediate potential Ve, and further performs the second-stage pushing by the contracting waveform component e from the potential Vg.

Here, when the pushing of the meniscus is performed in two stages, and the droplet speed of an excessive faint small droplet (satellite droplet) positioned on the tail of the ejected droplet (main droplet) is made higher, the generation of the satellite can be suppressed, as described above.

Then, when the first-stage pushing voltage is made higher than the intermediate potential Ve, the droplet voltage (the droplet amount) of the final ejected droplet D5 can be made larger than the droplet amount of the droplet D4 ejected in the drive pulse P4, and the droplet speed of the final ejected droplet D5 can be made higher than the droplet speed of the droplet D4.

Accordingly, even if the ejection bending is caused in the fourth droplet D4, a large droplet D15 having rectilinearity and less satellites is formed on the whole when merging is performed while the influence of the bending is offset according to the droplet voltage and the droplet speed of the final ejected droplet D5.

Next, the middle droplet ejection drive waveform uses the drive pulses P3 and P5. Since both cases include the waveform component that suppresses the ejection bending by the two-stage pulling-in, the ejection bending is less likely to be caused, and a middle droplet having the rectilinearity and fewer satellites can be formed, similarly to the large droplet.

Next, the small droplet ejection drive waveform uses the drive pulse P5. Since the drive pulse P5 includes the waveform component that suppresses the ejection bending by the two-stage pulling-in, the ejection bending is less likely to be caused, and a small droplet having the rectilinearity and fewer satellites can be formed, similarly to the large droplet.

Note that, while the description has been given where the maximum frequency is 24 kHz, the waveform length is 37.1 μs or less, and the five-pulse configuration is used, the embodiment is not limited to the condition.

Next, a specific example of the drive waveform will be described. Note that a pulse interval is a time from an end point of voltage change of a preceding pulse of successive two pulses to a start point of the voltage change of a subsequent pulse. Further, Tc is a unique oscillation period (a resonance period) of the individual liquid chamber. Further, an 18° C. waveform, a 24° C. waveform, or a 34° C. waveform means, for example, a case of a drive waveform when the temperature is 18° C., because the drive waveform is corrected or modified according to the temperature.

A time in an expansion process by the waveform component a of the drive pulse P1: 3 μs (same as Tc)

A time in a first expansion process by the waveform component a1 of the drive pulses P3 and P5: 0.5 μs (1/6×Tc)

A time in a maintenance process by the waveform component b of the drive pulse P4: 1 μs (1/3×Tc)

A time in a second maintenance process by the waveform component b of the drive pulses P1 and P2, and the waveform component b2 of the drive pulses P3 and P5: 0.8 μs (4/15×Tc)

A pulse interval between the drive pulses P1 and P2: 0.4 μs (2/15×Tc)

A pulse interval between the drive pulses P2 and P3: 3.2 μs (16/15×Tc)

A pulse interval between the drive pulses P3 and P4: 1.1 μs (11/30×Tc)

A pulse interval between the drive pulses P4 and P5: 2.8 μs (the 18° C. waveform) and 2.9 μs (the 24° C. waveform and the 34° C. waveform)

A time in a first expansion process by the waveform component a1 of the drive pulses P3 and P5: 0.5 μs (1/6×Tc)

A time in a first maintenance process by the waveform component b1 of the drive pulses P3 and P5: 2.2 μs (11/15×Tc)

A time in a contraction process by the waveform component c of all drive pulses: 1 μs (1/3×Tc)

A time in a third maintenance process by the waveform component d of the drive pulse P5: 1.6 μs (the 18° C. waveform), 1.4 μs (the 24° C. waveform), and 1 μs (the 34° C. waveform)

A time in a fourth maintenance process by the waveform component f of the drive pulse P5: 2.5 μs (5/6×Tc)

A time in a third expansion process by the waveform component g of the drive pulse P5: 1 μs (the 18° C. waveform and the 24° C. waveform), and 2 μs (the 34° C. waveform)

Figure 13:
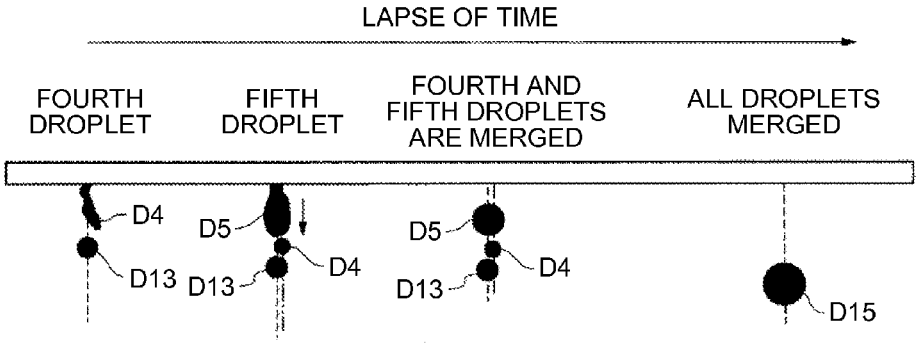
FIG. 13 is an explanatory diagram describing merging of large droplets formed in a large droplet ejection drive waveform in a second embodiment.

Next, a second embodiment of the present invention will be described with reference to FIG. 13. FIG. 13 is an explanatory diagram describing merging of ejected droplets at formation of a large droplet in the second embodiment.

In the present embodiment, the droplet speeds of the third to fifth droplets are set such that the fourth droplet D4 is merged with the subsequently ejected fifth droplet D5 before being merged with the droplet D13 obtained by merging of the first to third droplets, and is then merged with the droplet D13 obtained by merging of the first to third droplets.

That is, since the droplet volume of the fifth droplet D5 is large, the droplet D5 can offset bending of the fourth droplet D4. Therefore, the droplet D4 is merged with the preceding droplet after being absorbed in the droplet D5, so that the bending of the droplet D4 cannot influence on the preceding droplet.

In contrast, if the fourth droplet D4 is merged with the preceding droplet D13 that has been previously ejected, the merged droplet is subject to the influence of the ejection bending of the fourth droplet D4, and may bend. If so, only the rectilinearity by the droplet volume and the droplet speed of the fifth droplet D5 may not be able to offset the bending of the relatively large merged droplet.

As described above, the droplet ejected in the first pulse is combined with the droplet ejected in the second pulse during flying before being combined with the droplet ejected before the droplet ejected in the first pulse during flying, whereby the influence of the bending can be reliably prevented.

Figure 14:
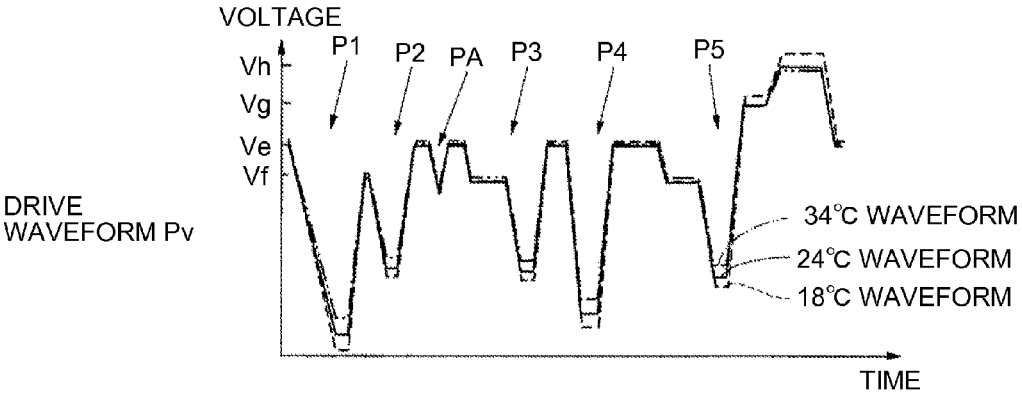
FIG. 14 is an explanatory diagram of drive waveforms in a third embodiment of the present invention.

Next, a third embodiment of the present invention will be described with reference to FIG. 14. FIG. 14 is an explanatory diagram of drive waveforms for describing the third embodiment.

In the present embodiment, a plurality of drive waveforms is held in advance according to an environment temperature. To be specific, a waveform of an 18° C. environment is held as a low-temperature environment, a waveform of a 24° C. environment is held as a normal-temperature environment, and a waveform of a 34° C. environment is held as a high-temperature environment.

That is, under the low-temperature environment, the viscosity of the ink is higher than the normal-temperature environment. Therefore, it is necessary to make the wave height value of the waveform large. In contrast, under the high-temperature environment, the viscosity of the ink is lower than the normal-temperature environment. Therefore, it is necessary to make the wave height value of the waveform small. Accordingly, even if the environment is changed, the droplet volume and the droplet speed are unchanged.

Therefore, a high quality image without the ejection bending can be formed without being influenced by an environment.

In the present application, the term "sheet" is not limited to the paper material, and also includes an OHP sheet, fabrics, glass, boards, and the like, on which ink droplets or other liquid can be attached. The term "sheet" includes a recorded medium, recording medium, recording paper, recording sheet, and the like. Further, image formation, recording, printing, image printing, and the like are synonyms.

Further, the "image forming apparatus" means a device that forms an image by ejecting a liquid to media such as paper, thread, fiber, fabric, leather, metal, plastic, glass, wood, ceramic, and the like. Further, the "image formation" means not only providing images such as letters or figures having meaning to the medium, but also providing images without meaning such as patterns to the medium (and impacting the liquid droplets to the medium).

Further, the "ink" is not limited to so-called ink, and is used as a collective term for every liquid such as a recording liquid, a fixing liquid, and a fluid that can be used for image formation, otherwise limited in particular. For example, DNA samples, registration and pattern materials and resins are included.

Further, the "image" is not limited to a plane image, and also includes a three-dimensionally formed image, and an image formed such that a solid body is three-dimensionally molded.

Further, the image forming apparatus includes, otherwise limited in particular, any of a serial-type image forming apparatus and a line-type image forming apparatus.

According to the embodiment, an increase in waveform length of a drive waveform is suppressed while ejection bending is suppressed, and high frequency driving can be made possible.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a liquid ejection head including a plurality of nozzles configured to eject a liquid droplet, an individual liquid chamber to which the nozzles communicate, and a pressure generation unit configured to generate a pressure for pressurizing a liquid in the individual liquid chamber; and a head drive control unit configured to generate a drive waveform including a plurality of pulses in time series, select one or more pulses from the drive waveform according to a droplet size, and provide the selected drive pulses to the pressure generation unit, wherein the drive waveform at least includes a first pulse not including a waveform component that suppresses ejection bending, and allowing a droplet to be ejected, and following the first pulse, a second pulse including the waveform component that suppresses ejection bending, and allowing a droplet to be ejected, and a droplet amount of the droplet ejected in the second pulse is larger than a droplet amount of the droplet ejected in the first pulse, and a droplet speed of the droplet ejected in the second pulse is higher than a droplet speed of the droplet ejected in the first pulse.

2. The image forming apparatus according to claim 1, wherein the droplet ejected in the first pulse is combined with the droplet ejected in the second pulse during flying before being combined with a droplet ejected before the droplet ejected in the first pulse during flying.

3. The image forming apparatus according to claim 1, wherein a pulse allowing a first droplet to be ejected, the first droplet forming liquid droplets having different droplet sizes includes the waveform component that suppresses ejection bending.

4. The image forming apparatus according to claim 3, wherein, in the pulse allowing the first droplet to be ejected, a falling time of a pulling-in waveform component allowing a volume of the individual liquid chamber to be expanded is longer than a falling time of a pulse allowing a subsequent droplet to the first droplet to be ejected.

5. The image forming apparatus according to claim 3, wherein, in the pulse allowing the first droplet to be ejected, the pulling-in waveform component allowing a volume of the individual liquid chamber to be expanded is a waveform component allowing the volume of the individual liquid chamber to be expanded in two stages.

6. The image forming apparatus according to claim 1, wherein the second pulse includes a waveform component that makes a droplet speed of a satellite droplet higher than a droplet speed of a main droplet.

7. A method of driving and controlling a liquid ejection head that includes a plurality of nozzles configured to eject a liquid droplet, an individual liquid chamber to which the nozzles communicate, and a pressure generation unit configured to generate a pressure for pressurizing a liquid in the individual liquid chamber, the method comprising:

generating a drive waveform including a plurality of pulses in time series;

selecting one or more pulses from the drive waveform according to a droplet size; and providing the selected drive pulses to the pressure generation unit, wherein the drive waveform at least includes a first pulse not including a waveform component that suppresses ejection bending, and allowing a droplet to be ejected, and following the first pulse, a second pulse including the waveform component that suppresses ejection bending, and allowing a droplet to be ejected, and a droplet amount of the droplet ejected in the second pulse is larger than a droplet amount of the droplet ejected in the first pulse, and a droplet speed of the droplet ejected in the second pulse is higher than a droplet speed of the droplet ejected in the first pulse.

* * * * *